United States Patent [19]

Kurz

[11] Patent Number: 4,815,050

[45] Date of Patent: Mar. 21, 1989

[54] COMPLAINT TUBE LOW FREQUENCY SOUND ATTENUATOR

[75] Inventor: Charles B. Kurz, Santa Ana, Calif.

[73] Assignee: Brunswick Corporation

[21] Appl. No.: 739,513

[22] Filed: May 31, 1985

[51] Int. Cl.[4] ..... H04R 17/00

[52] U.S. Cl. ..... 367/176; 181/286

[58] Field of Search ..... 367/141, 149, 153, 154, 367/160, 161, 162, 163, 164, 165, 166, 167, 168, 169, 170, 171, 172, 173, 174, 176, 178, 180, 181; 310/323, 330, 331, 336, 337, 345, 353, 800; 181/156, 168, 169, 171, 172, 173, 174, 196, 197, 207, 208, 209, 264, 269, 271, 277, 287, 286, 288, 175, 198, 282, 233

[56] References Cited

U.S. PATENT DOCUMENTS

| | | | |
|---|---|---|---|
| 2,789,280 | 4/1957 | Harris | 367/174 |
| 2,811,216 | 10/1957 | Harris | 367/1 |
| 3,018,465 | 1/1962 | Harris | 367/172 |
| 3,056,908 | 10/1962 | Estes et al. | 367/174 X |
| 3,116,635 | 1/1964 | McQuitly | 367/171 X |
| 3,143,691 | 8/1964 | Hurd | 367/171 X |
| 3,157,204 | 11/1964 | Phillip | 138/120 |
| 3,198,998 | 8/1965 | Powers et al. | 367/174 X |
| 3,214,647 | 10/1965 | Louzos et al. | 367/174 X |
| 3,241,099 | 3/1966 | Elston et al. | 367/165 |
| 3,264,605 | 8/1966 | Vincent | 367/141 |
| 3,500,305 | 3/1970 | Vincent | 367/172 |
| 3,538,494 | 11/1970 | Erickson | 367/174 |
| 3,907,062 | 9/1975 | Brigham et al. | 367/157 |
| 4,140,992 | 2/1979 | Wardle | 367/153 |
| 4,158,189 | 6/1979 | Wardle | 367/152 |
| 4,184,093 | 1/1980 | Sullivan | 310/331 |
| 4,188 ,609 | 2/1980 | Mott | 367/152 |
| 4,195,280 | 3/1980 | Hillery | 367/171 |
| 4,197,522 | 4/1980 | Christoph | 367/149 |
| 4,386,676 | 6/1983 | Gadde et al. | 181/290 |
| 4,395,908 | 8/1983 | Shopland | 367/163 X |
| 4,399,526 | 8/1983 | Eyhch | 367/153 X |
| 4,450,544 | 5/1984 | Denaro et al. | 367/176 |
| 4,524,693 | 6/1985 | McMahon et al. | 367/163 X |
| 4,532,450 | 7/1985 | McNeel et al. | 310/331 X |
| 4,536,862 | 8/1985 | Sullivan et al. | 367/153 |
| 4,669,573 | 6/1987 | Goodman | 181/286 |

*Primary Examiner*—Brian S. Steinberger

*Attorney, Agent, or Firm*—Finnegan, Henderson, Farabow, Garrett & Dunner

[57] ABSTRACT

An apparatus for attenuating low frequency sound in a high static pressure environment comprises a hollow, tube-shaped structure having two, free-bending spans disposed opposite each other and enclosed in an evacuated thin plastic envelope or bag. Each of the hinged spans has a flexural strength exceeding 200,000 psi and an elastic modulus exceeding 20,000,000 psi. The shape of the spans can be planar or curved, and the ends of the spans are closed. The spans having a planar cross section are supported adjacent their peripheries by T-shaped members, each of which includes an inwardly projecting flange which contacts and supports the spans. The curved-span embodiment employ two suitably shaped plugs which contact and support the two ends of the spans.

25 Claims, 3 Drawing Sheets

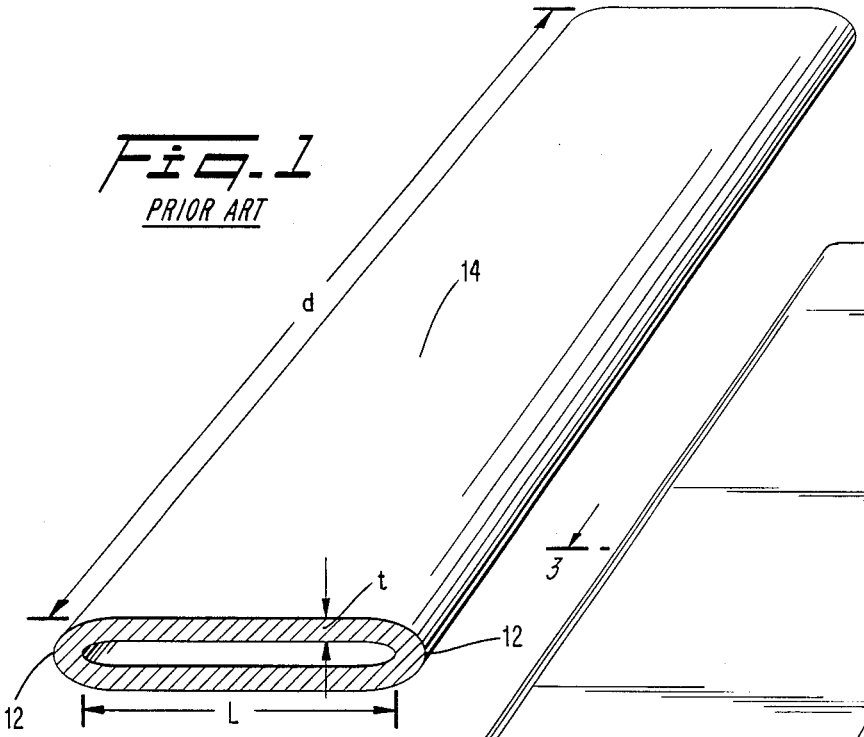
Fig. 1
PRIOR ART
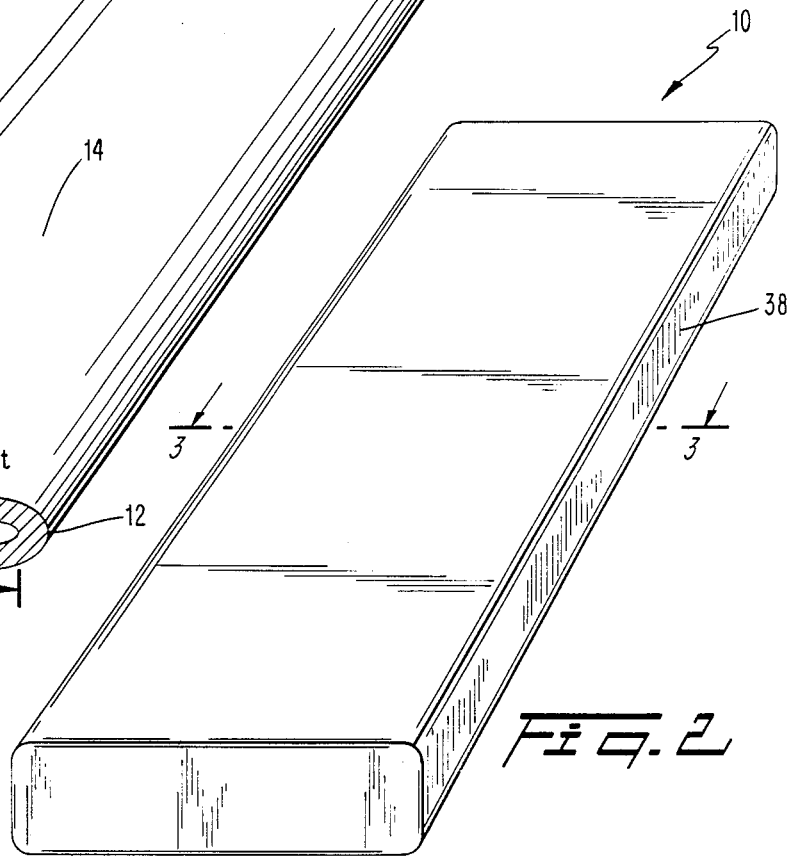
Fig. 2
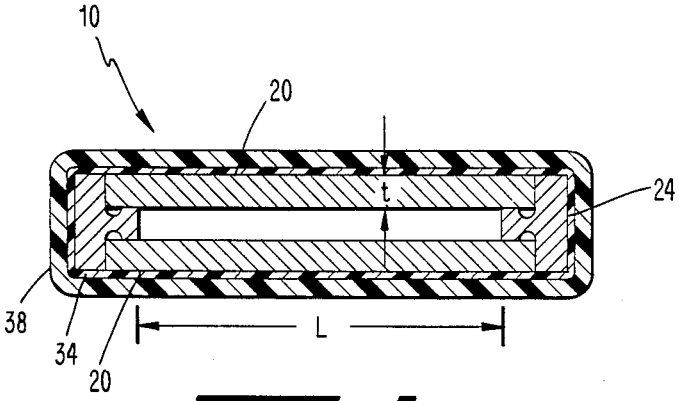
Fig. 3
Fig. 4
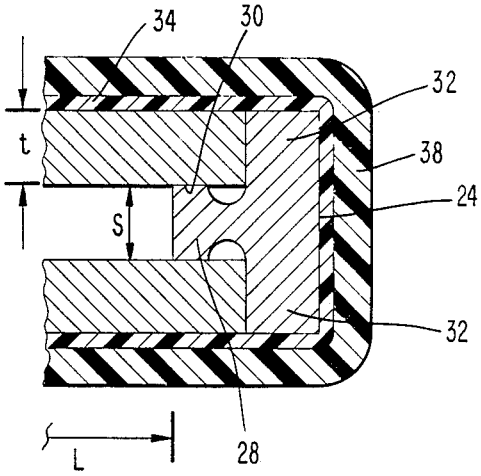

Fig. 5a
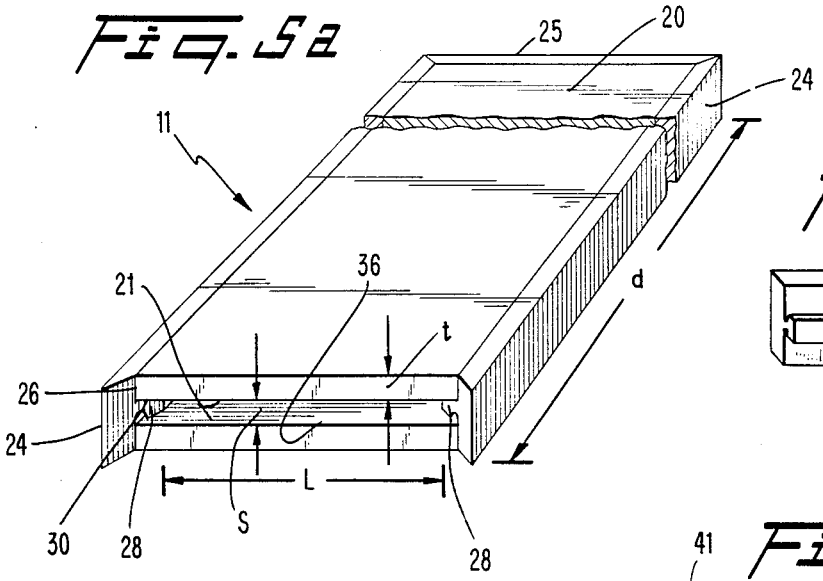
Fig. 5b
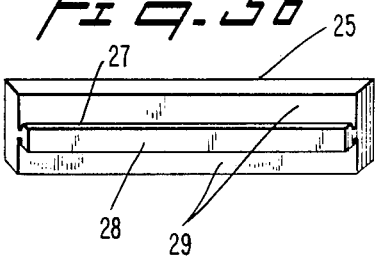
Fig. 6
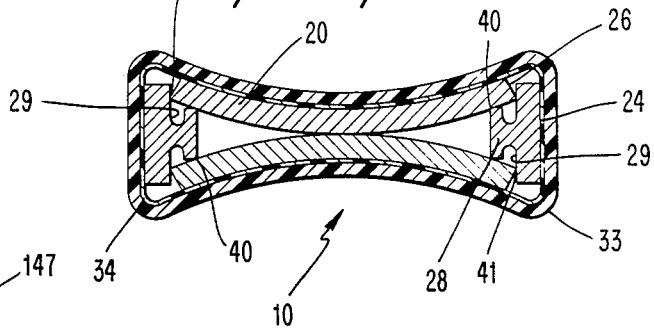
Fig. 7a
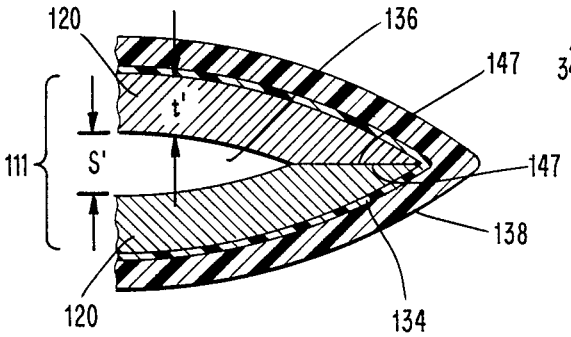
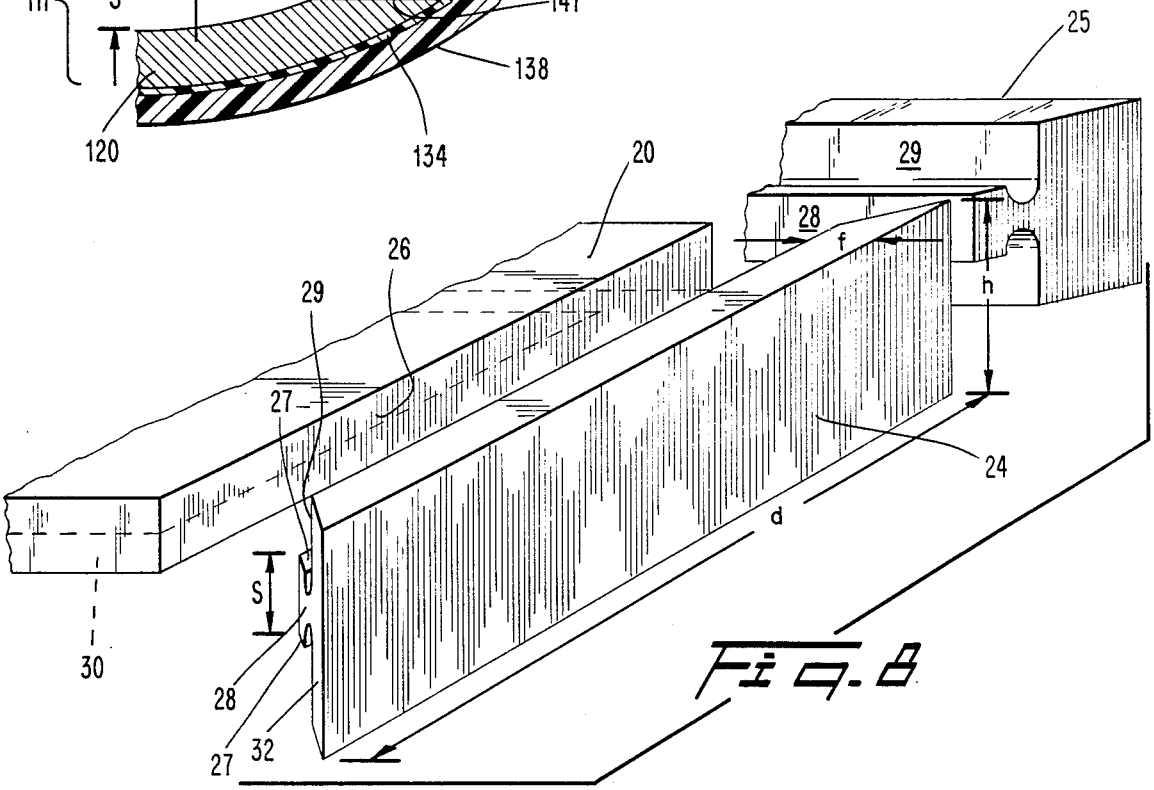
Fig. 8

COMPLAINT TUBE LOW FREQUENCY SOUND ATTENUATOR

BACKGROUND OF THE INVENTION

1. Field of the Invention

This invention is related to an apparatus for preventing the transmission of sound in a medium, and in particular a compliant tube sound attenuator capable of attenuating low frequency sound in a hydrostatic pressure environment.

2. The Prior Art

A basic method of preventing the transmission of sound in a medium requires the introduction of a significant density discontinuity in the medium. For example, sound attenuation in a low density medium requires the introduction of a high density material such as a slab of steel to create a high density discontinuity in the low density medium. Similarly, in a high density medium, sound attenuation can be achieved by introducing a low density material such as air as a discontinuity in the high density medium. Thus, a water/air interface would serve as an effective sound attenuator in water.

A captive arrangement of air bubbles can serve as a sound attenuator in a water medium. To be effective, the hydrostatic water pressure of the medium must not exceed the pressure required to collapse the bubbles. A layer of rubber containing air cavities has been used successfully as a sound attenuator in a water medium at hydrostatic pressures less than approximately 150 pounds per square inch (psi). Such sound attenuators are commonly referred to as air-rubber baffles.

An enclosure stiffer than rubber is required to attenuate sound in a water environment at pressures higher than 150 psi. At such pressures, the air bubbles would collapse, and thus no sound would be attenuated. Enclosures stiff enough to withstand high levels of hydrostatic pressure can at the same time offer little or no resistance to sound pressure. Thus, if a stiff enclosure is constructed to exhibit resonant vibrations (with accompanying changes of the enclosed volume) at prescribed frequencies, the enclosure in effect becomes "soft" in the presence of sound pressure fluctuations at these prescribed frequencies. In other words, the enclosure is statically "stiff" but dynamically "soft." The vibration of the stiff enclosure absorbs the sound energy at the resonant frequency, but does not transmit this energy through the low density space inside the enclosure. An enclosure so designed thus acts as an efficient barrier against sound propagation at the prescribed resonant frequencies and therefore is considered a "tuned resonant baffle," commonly referred to as a "compliant tube baffle."

As shown in FIG. 1, a conventional compliant tube is essentially a tube of near oval cross section whose long sides 14 vibrate as plates and whose curved edges 12 function as built-in nodes of vibration. Examples of conventional compliant tubes are shown in U.S. Pat. Nos. 3,264,605 and 3,907,062, the disclosures of which patents are hereby incorporated herein by reference. Such conventional compliant tubes are limited in their ability to attentuate relatively low frequency sound in a hydrostatic pressure environment. As explained in U.S. Pat. No. 3,264,605, as increasing pressure is exerted on the tube, the long walls of the tube bend toward the middle, and the curved or convex edges are drawn into a smaller arc. Thus, the pressure exerted on the tube forces the curved or convex edges (designated by the numeral 12 in FIG. 1) into a smaller arc. The stress on edges 12 increases with increasing pressure. Eventually, the pressure increases to a value that causes the tube to rupture and renders the tube useless.

The maximum static pressure which the tube is capable of withstanding can be increased by making the curved edges thicker. However, increasing the thickness of the tube wall at the edges results in two disadvantages, increased weight and an increase in the tuned frequency of the tube. Extra weights is undesirable in submarine applications such as disclosed in U.S. Pat. No. 3,907,062. The greater thickness of the tube wall also precludes the attenuation of low frequencies (i.e., less than 1,000 Hz) because the frequencies below which attentuation does not occur increase with increasing wall thickness. Thus, thickening the tube walls is not an acceptable solution in applications requiring attenuation of lower frequencies in hydrostatic pressure environments.

The solution of U.S. Pat. No. 3,264,605 of introducing a relatively noncompressible fluid inside the tube is marginally effective to prevent rupturing of the tube at higher pressures than the tubes could withstand without the presence of the noncompressible fluid. However, in some applications the added weight of the noncompressible fluid is equally undesirable as the weight added by the increased thickness of the tube wall. Moreover, the frequencies capable of being attenuated by the tube containing a noncompressible fluid are relatively higher than frequencies capable of being attenuated by a hollow tube which is similar in all respects except for the presence of the non-compressible fluid.

SUMMARY OF THE INVENTION

It is a principal object of the present invention to provide an apparatus which prevents the transmission of low frequency sound in a hydrostatic pressure environment and yet is relatively lighter in weight than conventional apparatus and capable of withstanding higher static pressures.

Another object of the present invention to provide such an apparatus which can attenuate sound frequencies below 1,000 Hz.

Additional objects and advantages of the invention will be set forth in part in the description which follows, and in part will be obvious from the description, or may be learned by the practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus for attenuating low frequency sound in a high static pressure environment comprises a hollow, tube-shaped structure having two, free-bending spans disposed a preselected distance opposite each other during their unflexed state and supported adjacent their peripheries on all four edges, each span having a flexural strength which exceeds the flexural stress when loaded and the spans are touching each other, and an elastic yield point higher than the strain imposed by deflection during operation.

The accompanying drawings, which are incorporated in and constitute a part of this specification, illustrate specific embodiments of the invention and, together with the description, serve to explain the principles of the invention.

BRIEF DESCRIPTION OF THE DRAWINGS

FIG. 1 is a perspective view of an embodiment of a conventional compliant tube apparatus;

FIG. 2 is a perspective view of a preferred embodiment of the present invention constructed in accordance with the present teachings;

FIG. 3 is a cross-sectional view of the embodiment of FIG. 2 taken along the line 3—3;

FIG. 4 is an enlarged partial view of FIG. 3 in cross section;

FIG. 5*a* is a perspective view of a portion of the embodiment of the invention shown in FIG. 2; FIG. 5*b* is a perspective view of an end member of FIG. 5*a;*

FIG. 6 is a cross-sectional view of an embodiment of the present invention, similar to the view of FIG. 3, showing deflection of the loaded spans;

FIG. 7*a* is a view of a second preferred embodiment of the present invention constructed in accordance with the present teachings and shown in a cross-sectional view similar to the view of FIG. 4.

FIG. 8 is an exploded, perspective view of an embodiment of the flange portion of the embodiment of the invention shown in FIG. 2 or 5;

DETAILED DESCRIPTION OF THE PREFERRED EMBODIMENTS

Figure 7B:
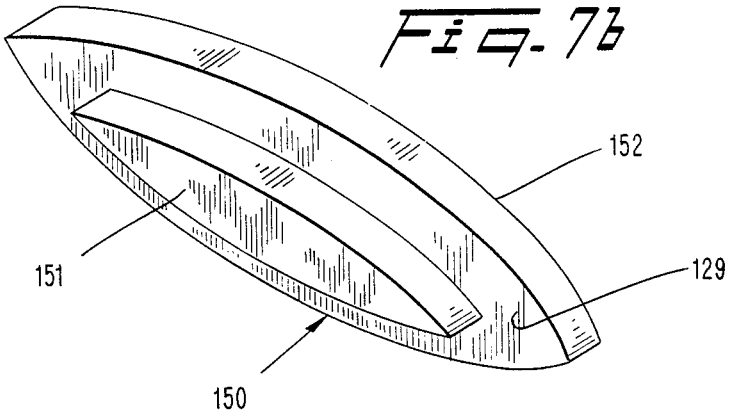
FIG. 7*b* is a perspective view of one of the two identical end members for the embodiment of FIG. 7*a;*

Reference now will be made in detail to the present preferred embodiments of the invention, examples of which are illustrated in the accompanying drawings.

A preferred embodiment of the apparatus for attenuating low frequency sound in a hydrostatic pressure environment is shown in FIGS. 2–6 and 8 and is represented generally by the numeral 10. In accordance with the present invention, a hollow, tube-shaped structure is provided having two, free-bending spans. These spans are simply supported adjacent their peripheries on all four edges, in effect providing hinged spans. The spans are disposed a preselected distance opposite each other during the unflexed condition of the spans, this distance being approximately equal to the total elastic deformation of both spans at a pressure slightly greater than that anticipated at the maximum depth at which sound attenuation is required. The preferred materials for the low frequency and high hydrostatic pressure environments encountered by the present invention have a high flexural strength and a high elastic modulus. Typically suitable are steel alloys which have a flexural strength in excess of 250,000 psi and an elastic modulus in excess of $28\times10^6$ psi.

As embodied herein and shown in perspective in FIG. 2, in cross-sectional views in FIGS. 3, 4, 5*b* and 6, and in perspective views in FIGS. 5*a* and 8, a hollow, rectangular tube-shaped structure 11 includes two free-bending, edge supported or hinged spans 20. Each span or face 20 is formed of a flat metal plate of thickness "t" (FIGS. 3, 4 and 5*a*), free-bending width "L" (FIGS. 3, 4 and 5*a*) and length "d" (FIGS. 5*a* and 8). The hinged spans can preferably be fabricated using any high elastic modulus material with good flexural characteristics such as 4130 steel or 4340 steel or a graphite, fiber-reinforced, plastic laminate. The spans should at a minimum have a flexural strength of 200,000 psi and a minimum elastic modulus of $20\times10_6$ psi. In accordance with the invention, the flexural strength of each span exceeds the flexural stress when loaded and the spans are touching each other, and the elastic yield point of each span is higher than the strain imposed by deflection during operation.

In accordance with the invention, the spans are hinged, i.e., connected, in a free-bending manner such that upon loading they deflect freely perpendicular to their planes. This deflection causes the spans to rotate around their supportive edge fulcrums and thus act as if hinged. This specific method of support enables the attainment of the low "natural" frequency of vibration required with a unit of practical size and capable of withstanding the high external pressure encountered in the sea at great depths. In the embodiment shown in FIGS. 2–6, and 8, this hinging of the spans 20 is accomplished by use of two elongated edge members 24 having substantially T-shaped cross sections which supports the two spans along their length "d." As shown, each edge member 24 has a flange 28 that projects inwardly and contacts and supports the longitudinal, inner edges of both spans 20. Thus, as shown in FIG. 5, for example, flange 28 of each T-shaped edge member 24 separates the oppositely disposed, inwardly facing planar surfaces 21 of opposed spans 20. The height of the void portion 36 of tube-shaped structure 11 is defined by the thickness of flange 28 of T-shaped end members 24 and is denoted as "S."

In accordance with the invention, each end of the tubular structure 11 is closed by an end member or cap. One such end member 25 is shown in FIGS. 5*a* and 8, and in cross section in FIG. 5*b*. As embodied herein, the two end members 25 are of the same cross-sectional T-shape as the two edge members 24 and thus also include a flange 28 of thickness S which projects inwardly and contacts and supports the spans 20 adjacent their inner, end edges. An extrusion of aluminum is the preferred method of generating the shape of these end and edge members which can then be cut to the desired lengths. Prior to assembly, the edges of these members 24, 25 are preferably mitered so that they fit snugly at the corners of the opposed spans 20 and enclose and define the void portion or cavity 36. Thus, with reference to the exploded view of FIG. 8, the entire inner edge 30 of each span is designed to rest freely on one of the two flat sides 27 of flange 28 of the edge and end members 24, 25. The entire edge face 26 of each span 20 abuts against one of the two underside surfaces 29 of base portion 32 of the edge and end members 24, 25.

In accordance with the present invention, means are provided to enclose the hollow, tube-shaped structure in a vacuum. As embodied herein and shown in FIG. 4, for example, this enclosing means comprises a sealed envelope or bag 34, preferably of polyurethane and having a thickness of about 20 thousandths of an inch, which closely envelopes the tube-shaped structure 11 making it air and water tight. Preferably, once the structure 11 is placed inside the polyurethane envelope, the envelope is evacuated to create a void inside the hollow cavity 36 of structure 11, and the envelope is sealed. The differential positive external pressure resulting from evacuation of cavity 36 holds each span 20 against edge and end members 24, 25 with a force that eliminates the need for any chemical adhesive or welding joint. Thus, the spans remain free-bending while being held in place.

This applied force establishes intimate contact of the edges 30 of the two spans to the flat sides 27 of the four flanges to provide the condition required to obtain resonant frequency response, and therefore, the desired acoustic attenuation. This is particularly useful when the ambient external hydostatic pressure is low, as is encountered in shallow regions. It is noteworthy that for embodiments destined to function at depths in excess of about 28 feet, the vacuum enclosure (preferably evacuated to 20 inches or more of mercury) is not always necessary to obtain the peripheral contact of the span edges with the flat sides 27.

As shown in FIG. 4, a protective layer 38 of a material compatible with sea water can also be applied completely around each tube 11, in addition to envelope 34, to encapsulate the tube and protect it against harsh chemical environments such as salt water and further seal the tube. Protective layer 38 is preferably of uniform thickness and made of a material which has low tensile and shear modulii and a specific gravity close to that of water, so that external acoustic pressures are transmitted to the compliant spans 20 without excessive reflection. Suitable materials are elastomers such as castable polyurethane polymer, Lamaca (a proprietary elastomer formulation of Brunswick Corporation) and moldable nitrile rubber compounds.

FIG. 6 shows an embodiment of the invention in a static pressure environment higher than the maximum static pressure in which the compliant tube embodiment is designed to operate. Each span 20 is loaded and deflects inwardly until opposite spans touch at the center and cease to attenuate sound frequencies. The corners 40 of the flanges 28 act as fulcrums about which the spans bend. Thus, contact remains between spans 20 and flanges 28, and envelope 34 and protective layer 38 stretch to accommodate movement of the spans 20. The structural integrity of the rectangular structure, i.e., resistance to collapse due to external pressure, is established by the contact of corners 41 of the bent spans 20 and surfaces 29 of members 24 which prevents members 24 from being displaced inwardly into the cavity 36. Thus, no rupturing occurs as is experienced in prior art structure.

The static pressure at which the compliant tube of the present invention becomes non-operational is much higher than the static pressure at which a conventional compliant tube, such as shown in FIG. 1, of equivalent span thickness "t" would be destroyed by stresses generated at curved edges 12. The free-bending hinge formed by the spans and flanges of the present invention reduces the stresses in the spans relative to the stresses present under similar bending conditions encountered in curved portions 12 of the prior art compliant tube structure shown in FIG. 1. The use of end members or caps 25 does reduce the compliance of the spans adjacent to the end members; however, the length "d" of the spans is selected to provide sufficient compliance of the spans in the areas not adjacent to the end members so that the spans will operate in conjunction with the flanges as free-bending hinges.

Thus, the compliant tubes of the present invention, while accommodating higher static pressures, need not be designed to withstand the same high stresses and therefore can use thinner spans than in comparable conventional structures. The reduced metal requirements of the present invention result in weight and bulk reductions for the compliant tube arrays used to attenuate sound in high static pressure environments. In addition, the reduced wall thickness requirements of the compliant tubes of the present invention enable the tubes to attenuate lower frequencies than the thicker-walled compliant tubes of the prior art. This latter advantage is attributable to the present invention because the frequency of attenuation is directly proportional to the thickness of the compliant tube wall such that the thinner the compliant tube wall thickness, the lower the sound frequency attenuated by the compliant tube.

Comparing the deflections of the prior art design of FIG. 1 with the present invention embodiment of FIG. 2, for the same span (i.e., width of tube) and tube wall thickness (i.e., section modulus) the respective deflections are:

For the conventional design shown in FIG. 1 $\delta_c = \frac{1\ pL^4}{384\ EI}$ For the new design of the present invention shown in FIG. 2 $\delta_n = \frac{5\ pL^4}{384\ EI}$ where $p$ = pressure
$E$ = Young's Modulus
$I$ = Moment of inertia of tube wall cross section
$L$ = Span of tube cross section
$\delta$ = deflection The subscript "c" denotes the conventional design and the subscript "n" denotes the new design of the present invention.

Defining compliance (C) as the ratio of deflection ($\delta$) to load (pL), the compliance of the respective designs are:

$$C_c = \frac{\delta_c}{pL} = \frac{L^3}{384\ EI}$$

$$C_n = \frac{\delta_n}{pL} = \frac{5L^3}{384\ EI}$$

Thus, for the same free-bending span L and wall thickness t, the new design is five times as compliant as the conventional design. Consequently, lower resonant frequencies can be achieved by the design of the present invention than are possible using the conventional design, as shown by the following mathematical argument:

$$f = \frac{1}{2\pi}\sqrt{\frac{k}{m}}$$

Since compliance C is the reciprocal of stiffness k, i.e., $$C = \frac{1}{k}\text{, it follows that } f \approx \sqrt{\frac{1}{Cm}}$$

$$\frac{(f_n)^2}{(f_c)^2} = \frac{C_c}{C_n}\ \frac{L_c}{L_n}\ \frac{t_c}{t_n}$$

where $f$ = resonant frequency
$m$ = mass = $Lt$
$t$ = thickness of free-bending span The span and thickness of the plate are not independent variables, being related to the stress. If the FIG. 2 embodiment of the present invention and the FIG. 1 embodiment are designed to withstand the same maximum stress, the following relationship governs their respective span and thickness requirements:

$$\frac{L_n}{L_c} = \frac{2}{3}\,\frac{t_n}{t_c}$$

which leads to $$\frac{C_n}{C_c} = \frac{5(2)^{3/2}}{(3)^{3/2}}$$

Therefore $$\frac{(f_n)^2}{(f_c)^2} = \frac{1}{5}\,\frac{(3)^{3/2}}{(2)^{3/2}}\,\frac{L_c}{L_n}\,\frac{t_c}{t_n}$$

$$= \frac{3}{10}\,\frac{(L_c)^2}{(L_n)^2} = \frac{9}{20}\,\frac{(t_c)^2}{(t_n)^2}$$

If $L_n = L_c$: $\frac{(f_n)^2}{(f_c)^2} = \frac{3}{10}$ and $\frac{t_n}{t_c} = \frac{3}{2}$ If $t_n = t_c$: $\frac{(f_n)^2}{(f_c)^2} = \frac{9}{20}$ and $\frac{Ln}{L_c} = \frac{3}{2}$ Accordingly, for the same stress in the material from which the spans are made and at the same pressure, the design of the present invention always yields a compliant tube which attenuates a lower sound frequency than can be achieved by the conventional design. Much of the applicable theoretical work defining response frequencies of freely supported rectangular plates is given in *Formulas for Natural Frequency and Mode Shape,* written by Robert D. Blevins, and published by Vam Nostrand Reinhold in 1979.

A second embodiment of the present invention is illustrated in cross section in FIG. 7*a*. In accordance with the invention, the hollow, tube-shaped structure comprises two, free-bending spans having a curved cross section. Each span is formed of two arcs each having a constant radius so that the thickness t' of each span is uniform throughout. The two longitudinal flat edges of each span rest on the respective oppositely facing two longitudinal flat edges of the oppositely disposed span so that the concave surfaces of the two spans of curved cross section face each other to enclose the hollow portion or cavity of the tube-shaped structure. As embodied herein, the hollow tube-shaped structure 111 includes two covered spans 120 each being provided at their longitudinal peripheries with a longitudinal flat edge 147. The two longitudinal flat edges 147 of the two oppositely disposed spans rest against each other to form the free-bending hinged portion of the hollow tube-shaped structure of the present invention. The maximum distance S' separating the two spans during the unloaded state is made approximately equal to the deflection of both spans 120 that occurs at the desired operating pressure.

The two ends of the structure 111 are closed and supported by an appropriately shaped end member or cap 150 shown in perspective in FIG. 7*b*. An internal plug 151 has the same curved shape and dimensions as the cross-section of the hollow space or cavity 136 of the structure 111 defined by the two curved spans 120. Plug 151 is connected to an external plate or flange 152 which abuts at surface 129 the edge faces formed at the long ends of spans 120.

The enclosing means of the embodiment of FIGS. 7*a* and 7*b* also comprises a thin polyurethane envelope or bag 134 which encloses the hollow tube-shaped structure 111. Envelope 134 is evacuated to create a vacuum inside the hollow portion 136 of tube-shaped structure and then sealed to maintain the vacuum so created. The differential pressure resulting from the evacuation of the envelope holds longitudinal edges 147 of the spans against each other and the end members 150 in place without the aid of other means of attachment. A protective layer 138 of one quarter to one half inch of elastomer encapsulant material, such as polyurethane or Lamaca, can be applied readily by a casting process, as in the first embodiment of the invention, over bag 134 to protect and seal each tube 111 against harsh chemical environments such as salt water.

Figure 9:
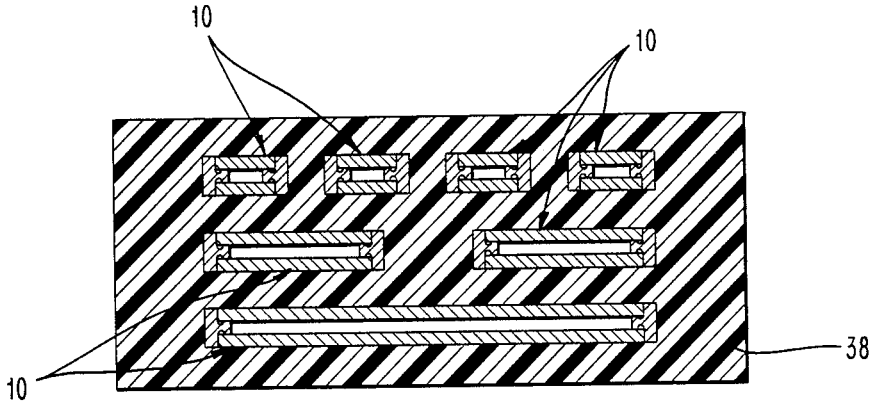
FIG. 9 is a cross-sectional view of an array of compliant tubes of a variety of sizes each constructed in accordance with the teachings of the present invention.

FIG. 9 shows an array of compliant tubes of varying sizes, each constructed in accordance with the teachings of the present invention. Each of the compliant tubes 10 is constructed as in FIG. 2, although the array could be comprised of compliant tubes constructed according to the embodiments of FIGS. 7 and 10. The compliant tubes 10 are presented in a cross sectional view, the same as shown in FIG. 3, except that the encapsulation by material 38 over each hollow, rectangular tube-shaped structure and its respective envelope 34 is preferably accomplished simultaneously over the multiplie layers of the compliant tubes. The use of an array of different sized compliant tubes as depicted here gives an expanded range of frequencies being attenuated.

Figure 10:
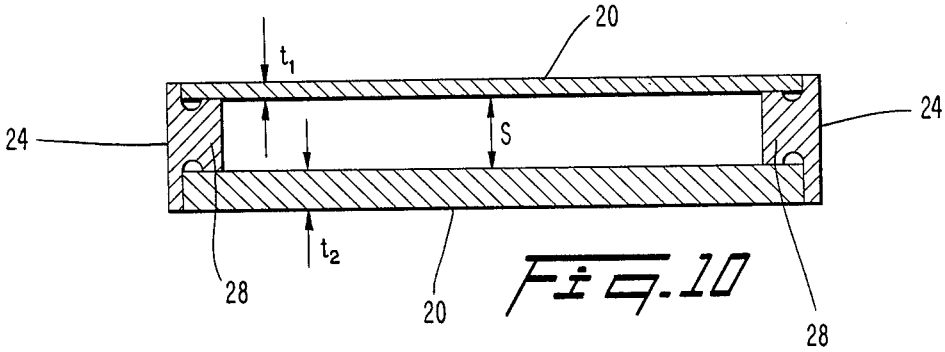
FIG. 10 is a cross-sectional view of a third preferred embodiment of the present invention showing spans of two different thicknesses.

Another embodiment of the invention is shown in cross section in FIG. 10 where the spans 20 are of different thicknesses $t_1$ and $t_2$. Because of this, the edge members 24 and end members 25 (not shown) will have offset flanges 28 as shown to support these two spans. The remainder of the construction of the compliant tube is as shown in FIGS. 2–6 and 8.

The purpose of this hybrid compliant tube is to broaden or expand the frequency range of attenuation beyond that resulting when two matched spans are employed. The distance S separating the spans is the total of the deflection of both spans at a pressure somewhat greater than that occurring at the maximum operating depth of the device.

It will be apparent to those skilled in the art that various modifications and variations could be made in the invention without departing from the scope or spirit of the invention. Thus, it is intended that the present invention cover the modifications and variations of this invention, provided such modifications and variations come within the scope of the appended claims and their equivalents.

What is claimed is:

1. An apparatus for attenuating low frequency sound underwater in a hydrostatic pressure environment, the apparatus comprising:

a hollow, tube-shaped structure having two, free-bending, resonant spans, each span having four edges at its periphery, said spans having flexed and unflexed states and disposed a preselected distance opposite each other during their unflexed state, edge members in contact with but not affixed to the four edges of both spans and supporting said spans adjacent their peripheries on all four edges, each span having a flexural strength which exceeds the flexural stress when loaded by hydrostatic pressure and the spans are touching each other during the flexed state, and an elastic yield point higher than the strain imposed by deflection of the span in response to hydrostatic pressure.

2. An apparatus as claimed in claim 1 further comprising means for enclosing said structure in a vacuum.

3. An apparatus as claimed in claim 1, wherein said edge members comprise a pair of substantially T-shaped edge members and a pair of substantially T-shaped end members, each of said members having an inwardly projecting flange and wherein each said span has an inwardly facing planar surface, and further wherein both of said inwardly facing planar surfaces of said spans are contacted and supported by all of said flanges of said T-shaped members which separate said oppositely disposed spans during the unflexed state of said spans.

4. An apparatus as claimed in claim 3, further comprising a gas-evacuated plastic film envelope for enclosing said structure in a vacuum.

5. An apparatus as claimed in claim 4, wherein said plastic film envelope is a polyurethane envelope.

6. An apparatus as claimed in claim 5, further comprising a protective layer surrounding said envelope.

7. An apparatus as claimed in claim 6, wherein said protective layer comprises a layer of elastomeric material.

8. An apparatus as claimed in claim 3 wherein said spans are of different thicknesses.

9. An apparatus as claimed in claim 1 wherein said spans are of different thicknesses.

10. A plurality of compliant tubes arranged in an array for attenuating a range of low-frequency sound underwater in a hydrostatic pressure environment, said compliant tubes being of different sizes and retained within an encapsulating material, each compliant tube being a hollow tube-shaped structure constructed in accordance with claim 1.

11. A compliant tube array as claimed in claim 10 wherein the spans in at least some of the compliant tubes are of different thicknesses.

12. An apparatus for attenuating low frequency sound underwater in a hydrostatic pressure environment, the apparatus comprising:

a hollow, tube-shaped structure having two, free-bending, resonant spans, said spans having flexed and unflexed states, each span being curved in cross section and having an inwardly facing concave surface, a pair of longitudinal flat edges and a pair of end edges, said concave surfaces of said spans facing each other to form said hollow, tube-shaped structure, and said longitudinal edges of each said span resting directly on the respective oppositely facing longitudinal edges of said oppositely disposed span, and a pair of end members for closing the ends of the structure and supporting the spans at the end edges;

wherein each span has a flexural strength which exceeds the flexural stress when loaded by hydrostatic pressure and the spans are touching each other during the flexed state, and an elastic yield point higher than the strain imposed by deflection of the span in response to hydrostatic pressure; and means for enclosing said structure in a vacuum.

13. An apparatus as claimed in claim 12, wherein said enclosing means comprises a gas-evacuated polyurethane envelope.

14. An apparatus as claimed in claim 12, further comprising a protective layer surrounding said envelope.

15. An apparatus as claimed in claim 12, wherein said protective layer comprises a layer of elastomeric material.

16. A plurality of compliant tubes arranged in an array for attenuating a range of low-frequency sound underwater in a hydrostatic pressure environment, said compliant tubes being of different sizes and retained within an encapsulating material, each compliant tube being a hollow tube-shaped structure constructed in accordance with claim 12.

17. An apparatus for attenuating low frequency sound underwater in a hydrostatic pressure environment, the apparatus comprising:

a hollow, tube-shaped structure having two, free-bending, resonant spans, each span having a pair of longitudinal edges and a pair of end edges and having flexed and unflexed states, said spans disposed a preselected distance opposite each other during their unflexed state, edge members in contact with but not affixed to at least the longitudinal edges of both spans and supporting said spans on at least the longitudinal edges, each span having a flexural strength which exceeds the flexural stress when loaded by hydrostatic pressure and the spans are touching each other during a flexed state, and an elastic yield point higher than the strain imposed by deflection of the span in response to hydrostatic pressure.

18. An apparatus as claimed in claim 17, wherein said edge members comprise at least a pair of substantially T-shaped edge members, each of said edge members having an inwardly projecting flange and wherein each said span has an inwardly facing planar surface, and further wherein both of said inwardly facing planar surfaces of said spans are contacted and supported by said flanges of said T-shaped edge members which separate said oppositely disposed spans during the unflexed state of said spans.

19. An apparatus as claimed in claim 18 further comprising means for enclosing said structure in a vacuum and a surrounding protective layer for said apparatus.

20. An apparatus as claimed in claim 19, wherein said enclosing means comprises a gas-evacuated plastic film envelope.

21. A plurality of compliant tubes arranged in an array for attenuating a range of low-frequency sound underwater in a hydrostatic pressure environment, said compliant tubes being of different sizes and retained within an encapsulating material, each compliant tube being a hollow, tube-shaped structure constructed in accordance with claim 17.

22. A compliant tube array as claimed in claim 21, wherein the spans in at least some of the compliant tubes are of different thicknesses.

23. An apparatus for attenuating low frequency sound underwater in a hydrostatic pressure environment, the apparatus comprising:

a hollow, tube-shaped structure having two, free-bending, resonant spans, said spans having flexed and unflexed states, each span being curved in cross section and having an inwardly facing concave surface, a pair of longitudinal flat edges and a pair of end edges, said concave surfaces of said spans facing each other to form said hollow, tube-shaped structure, and said longitudinal edges of each said span resting directly on the respective oppositely facing longitudinal edges of said oppositely disposed span, and a pair of end members for closing the ends of the structure;

wherein each span has a flexural strength which exceeds the flexural stress when loaded by hydrostatic pressure and the spans are touching each other during the flexed state, and an elastic yield point higher than the strain imposed by deflection of the span in response to hydrostatic pressure; and means for enclosing said structure in a vacuum.

24. An apparatus as claimed in claim 23 further comprising a surrounding protective layer.

25. A plurality of compliant tubes arranged in an array for attenuating a range of low-frequency sound underwater in a hydrostatic pressure environment, said compliant tubes being of different sizes and retained within an encapsulating material, each compliant tube being a hollow, tube-shaped structure constructed in accordance with claim 23.

* * * * *

UNITED STATES PATENT AND TRADEMARK OFFICE

CERTIFICATE OF CORRECTION

PATENT NO. : 4,815,050

DATED : March 21, 1989

INVENTOR(S) : Charles B. Kurz

It is certified that error appears in the above-identified patent and that said Letters Patent is hereby corrected as shown below:

IN THE TITLE: "COMPLAINT" should be --COMPLIANT--

Signed and Sealed this

Twenty-sixth Day of September, 1989

*Attest:*

DONALD J. QUIGG

*Attesting Officer*

*Commissioner of Patents and Trademarks*